US010657890B2

(12) United States Patent
Liu et al.

(10) Patent No.: US 10,657,890 B2
(45) Date of Patent: May 19, 2020

(54) PIXEL DRIVING CIRCUIT AND DRIVING METHOD THEREOF, DISPLAY DRIVING CIRCUIT, DISPLAY SUBSTRATE AND DISPLAY DEVICE

(71) Applicants: BEIJING BOE DISPLAY TECHNOLOGY CO., LTD., Beijing (CN); BOE TECHNOLOGY GROUP CO., LTD., Beijing (CN)

(72) Inventors: Song Liu, Beijing (CN); Hengyu Yan, Beijing (CN); Boxiao Lan, Beijing (CN); Jinhui Cheng, Beijing (CN); Zhiming Meng, Beijing (CN); Chunbing Zhang, Beijing (CN); Rui Guo, Beijing (CN); Hanzhang Niu, Beijing (CN); Jianzi He, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/051,284

(22) Filed: Jul. 31, 2018

(65) Prior Publication Data

US 2019/0122609 A1 Apr. 25, 2019

(30) Foreign Application Priority Data

Oct. 20, 2017 (CN) ..... 2017 1 0985056

(51) Int. Cl.
*G09G 3/3233* (2016.01)
*G09G 3/3258* (2016.01)
*G09G 3/3291* (2016.01)

(52) U.S. Cl.
CPC ..... *G09G 3/3233* (2013.01); *G09G 3/3258* (2013.01); *G09G 3/3291* (2013.01);
(Continued)

(58) Field of Classification Search
CPC .. G09G 3/3233; G09G 3/3258; G09G 3/3291; G09G 2300/0426; G09G 2300/0809
(Continued)

(56) References Cited

U.S. PATENT DOCUMENTS 9,449,559 B2 9/2016 In et al.
2003/0020413 A1* 1/2003 Oomura ..... G09G 3/3241 315/169.3

(Continued)

FOREIGN PATENT DOCUMENTS

CN 104200776 A 12/2014
CN 104282264 A 1/2015
CN 106910465 A 6/2017

OTHER PUBLICATIONS

Office Action dated Apr. 30, 2019, which issued in corresponding Chinese Patent Application No. 201710985056.0.

*Primary Examiner* — Kent W Chang
*Assistant Examiner* — Sujit Shah
(74) *Attorney, Agent, or Firm* — McDermott Will & Emery LLP

(57) ABSTRACT

A pixel driving circuit is provided, comprising: a current control circuit configured to provide a constant current signal and an activation signal, a current switching circuit configured to control the transmission of the constant current signal to a light-emitting device under the control of the activation signal, and a grounding control circuit configured to control the current control circuit to provide the constant current signal and the activation signal. An input terminal of the current control circuit is connected to a data line and a power line, respectively. A control terminal of the current switching circuit is connected to an output terminal of the current control circuit, an input terminal of the current switching circuit is connected to the input terminal of the
(Continued)

current control circuit, and an output terminal of the current switching circuit s connected to an input terminal of the light-emitting device.

14 Claims, 5 Drawing Sheets

(52) U.S. Cl.
CPC ..... *G09G 2300/0426* (2013.01); *G09G 2300/0809* (2013.01)

(58) Field of Classification Search
USPC ..... 345/55
See application file for complete search history.

(56) References Cited

U.S. PATENT DOCUMENTS

| | | | | |
|---|---|---|---|---|
| 2004/0201554 | A1* | 10/2004 | Satoh | G09G 3/3216 345/76 |
| 2005/0083270 | A1* | 4/2005 | Miyazawa | G09G 3/3233 345/76 |
| 2015/0138050 | A1* | 5/2015 | Kim | G09G 3/3233 345/76 |
| 2016/0078806 | A1* | 3/2016 | Lim | G09G 3/3275 345/690 |
| 2016/0307503 | A1 | 10/2016 | Song et al. | |

* cited by examiner

PIXEL DRIVING CIRCUIT AND DRIVING METHOD THEREOF, DISPLAY DRIVING CIRCUIT, DISPLAY SUBSTRATE AND DISPLAY DEVICE

The present application claims priority to Chinese Patent Application No. 201710985056.0 filed to the China Patent Office on Oct. 20, 2017 and entitled "PIXEL DRIVING CIRCUIT AND DRIVING METHOD THEREOF, DISPLAY DRIVING CIRCUIT, DISPLAY SUBSTRATE AND DISPLAY DEVICE", the disclosure of which is incorporated herein by reference in its entirety.

FIELD OF TECHNOLOGY

The present disclosure relates to the technical field of OLED display, and in particular to a pixel driving circuit and a driving method thereof, a display driving circuit and a driving method thereof, a display substrate and a display device.

BACKGROUND

As display devices capable of realizing self-illumination, wide angle of view and high contrast, Organic Light-Emitting Diode (OLED) display devices have been popular with people.

During the display of an OLED display device, a pixel driving circuit in the OLED display device drives OLED light-emitting devices of corresponding sub-pixels to emit light, so that the OLED display device displays pictures without backlight.

SUMMARY

In a first aspect, some embodiments of the present disclosure provide a pixel driving circuit, including:

a current control circuit configured to provide a constant current signal and an activation signal;

a current switching circuit configured to control the transmission of the constant current signal to a light-emitting device under the control of the activation signal; and a grounding control circuit configured to control the current control circuit to provide the constant current signal and the activation signal, wherein:

an input terminal of the current control circuit is connected to a data line and a power line, respectively; a control terminal of the current switching circuit is connected to an output terminal of the current control circuit, an input terminal of the current switching circuit is connected to the input terminal of the current control circuit, and an output terminal of the current switching circuit is connected to an input terminal of the light-emitting device; and, a control terminal of the grounding control circuit is connected to a gate line, an input terminal of the grounding control circuit is connected to an output terminal of the light-emitting device, and an output terminal of the grounding control circuit is grounded.

In some embodiments, the current control circuit includes an operational amplifier and a resistor; a first phase input terminal of the operational amplifier is connected to the data line; the power line is connected to a second phase input terminal of the operational amplifier via the resistor; an output terminal of the operational amplifier is connected to the control terminal of the current switching circuit; and, the second phase input terminal of the operational amplifier is also connected to the input terminal of the current switching circuit.

In some embodiments, the current control circuit further includes a voltage regulator connected to the data line.

In some embodiments, the current switching circuit includes a first transistor and a second transistor; and a control electrode of the first transistor is connected to the output terminal of the current control circuit, a first electrode of the first transistor is connected to the input terminal of the current control circuit, and a second electrode of the first transistor is connected to a control electrode of the second transistor; and, a second electrode of the second transistor is connected to the input terminal of the current control circuit, and a first electrode of the second transistor is connected to the input terminal of the light-emitting device.

In some embodiments, the type of the first transistor is opposite to the type of the second transistor.

In some embodiments, the grounding control circuit includes a third transistor; and, a control electrode of the third transistor is connected to the gate line, a second electrode of the third transistor is connected to the output terminal of the light-emitting device, and a first electrode of the third transistor is grounded.

In a second aspect, some embodiments of the present disclosure further provide a method for driving the pixel driving circuit described above, including steps of:

providing a gate signal by a gate line, and switching on a grounding control circuit in response to the gate signal;

providing a data signal by a data line, providing a power signal by a power line, and generating, by a current control circuit, a constant current signal and an activation signal according to the data signal and the power signal; and switching on a current switching circuit under the control of the activation signal, and transmitting the constant current signal to a light-emitting device through the current switching circuit so that the constant current signal drives the light-emitting device at constant current.

In some embodiments, when the pixel driving circuit includes a voltage regulator, before the step of providing a data signal by data line, the driving method further includes a step of:

changing the voltage of the data signal by the voltage regulator, so that the constant current signal changes in current.

In a third aspect, some embodiments of the present disclosure further provide a display driving circuit, including at least one pixel driving circuit described above.

In some embodiments, there is a plurality of pixel driving circuits which are arranged in an array, wherein:

the pixel driving circuits in each row, among the plurality of pixel driving circuits arranged in an array, share a current control circuit; or, the pixel driving circuits in each column, among the plurality of pixel driving circuits arranged in an array, share a current control circuit.

In a fourth aspect, some embodiments of the present disclosure further provide a display substrate, including the display driving circuit described above.

In some embodiments, current control circuits contained in pixel driving circuits in the display driving circuit are located within a border region of the display substrate.

In a fifth aspect, some embodiments of the present disclosure further provide a display device, including the display substrate described above.

In a sixth aspect, some embodiments of the present disclosure further provide a display device, including the display driving circuit described above.

BRIEF DESCRIPTION OF THE DRAWINGS

The accompanying drawings described herein are used for providing further understanding of the present disclosure and constitute a part of the present disclosure. Illustrative embodiments of the present disclosure and descriptions thereof are used for explaining the present disclosure and not intended to form any inappropriate limitations to the present disclosure, in which.

DETAILED DESCRIPTION OF THE EMBODIMENTS

The technical solutions in the embodiments of the present disclosure will be clearly and completely described below with reference to the accompanying drawings in the embodiments of the present disclosure. Apparently, the embodiments described herein are merely some but not all of the embodiments of the present disclosure. All other embodiments obtained by a person of ordinary skill in the art without paying any creative effort on the basis of the embodiments in the present disclosure shall fall into the protection scope of the present disclosure.

OLED light-emitting devices in the related art are current-driven devices. Since the luminance of the current-driven devices is approximately linearly related to the current, driving the OLED light-emitting devices to emit light by using a constant current source can effectively avoid the influence from the circuit impedance in the OLED display devices.

In order to solve the problem, pixel driving circuits have been designed in the related art to keep the output current constant. However, there are many electronic devices in the pixel driving circuits designed in the related art, so the structure is complicated, and the difficulty of manufacturing the pixel driving circuits is increased.

Some embodiments of the present disclosure provide a pixel driving circuit and a driving method thereof, a display driving circuit, a display substrate and a display device, in order to realize the constant-current driving of a light-emitting device under the premise of simplifying the structure of the pixel driving circuit.

Figure 1:
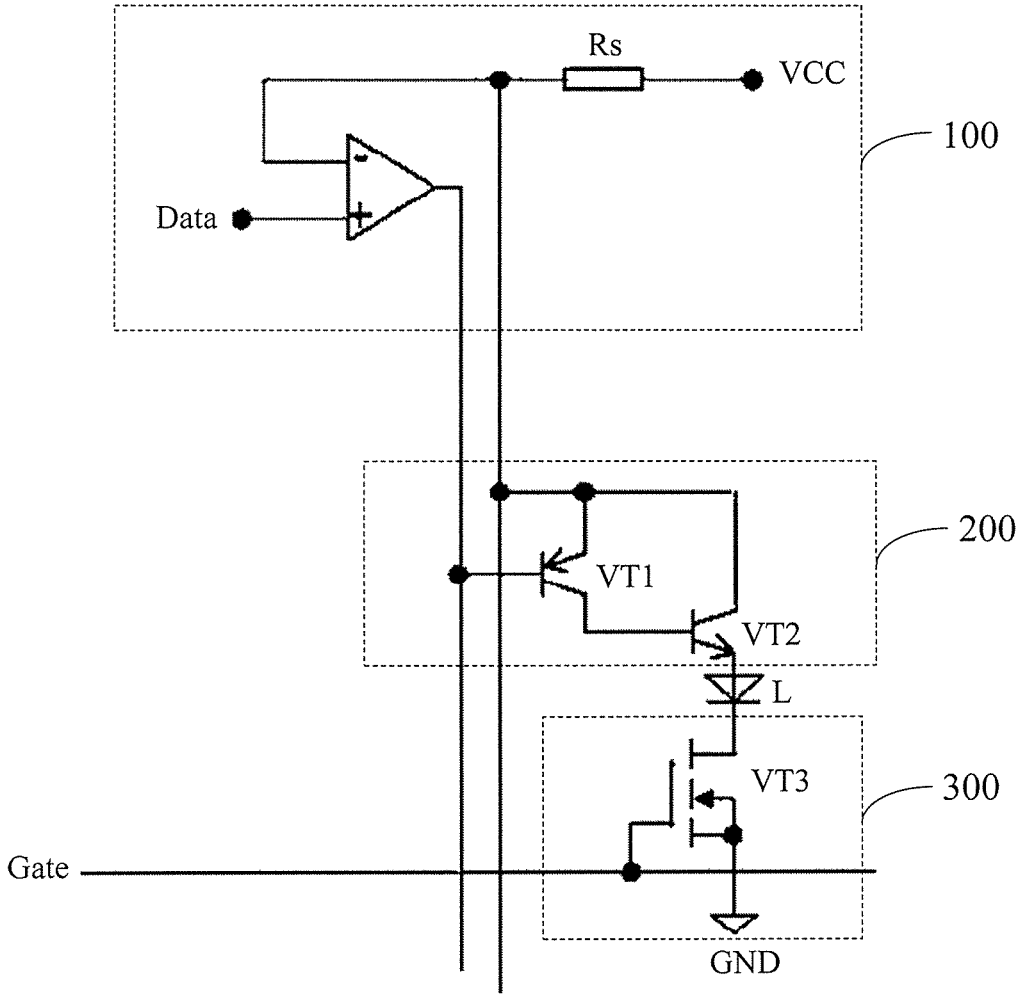
FIG. 1 is a first schematic structure diagram of a pixel driving circuit according to some embodiments of the present disclosure.
Figure 2:
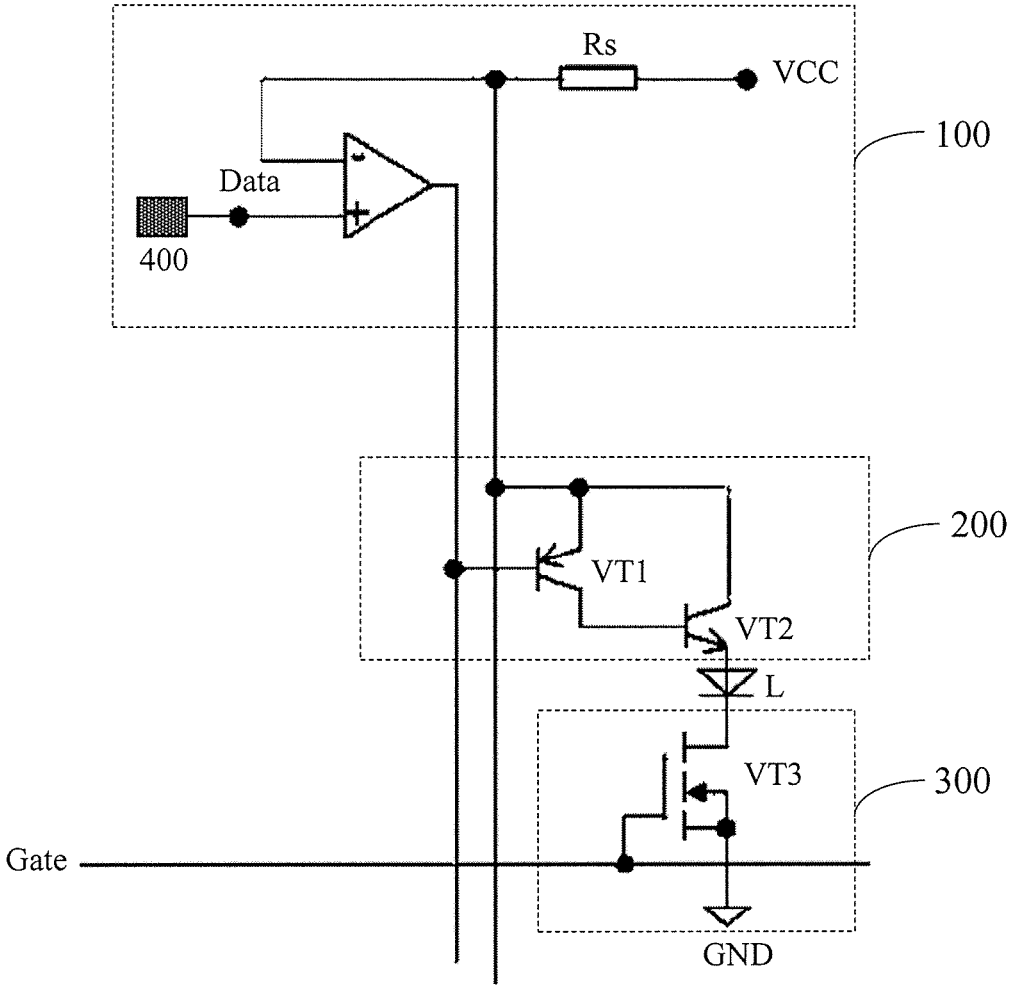
FIG. 2 is a second schematic structure diagram of the pixel driving circuit according to some embodiments of the present disclosure.
Figure 6:
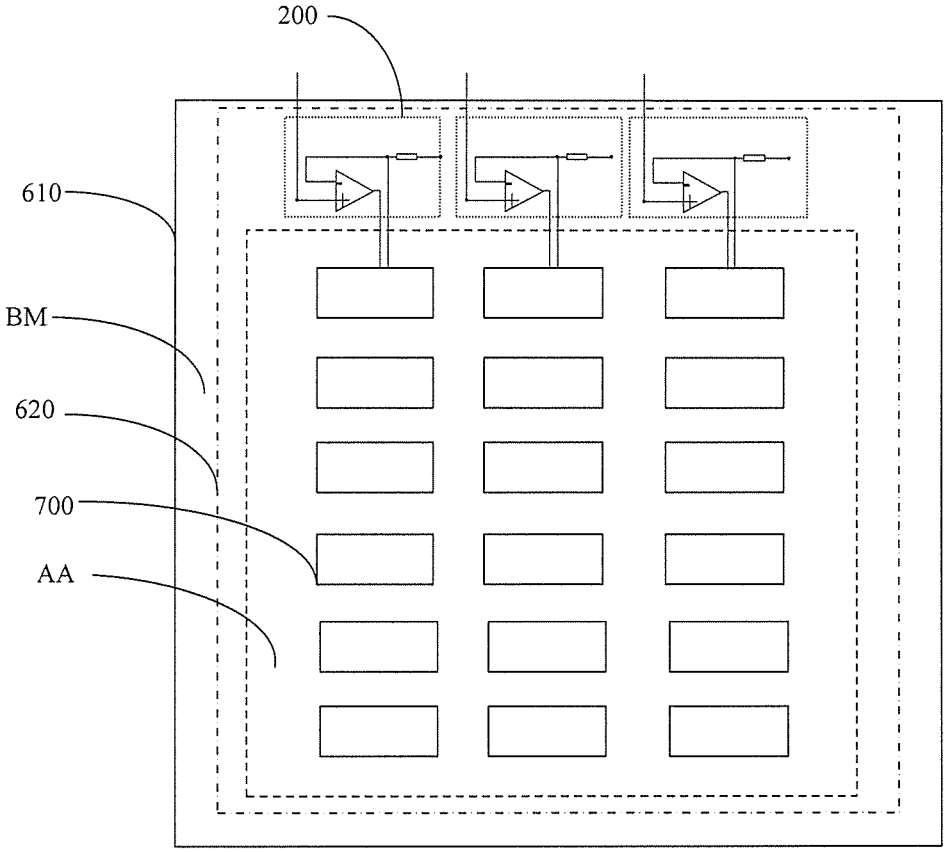
FIG. 6 is a schematic structure diagram of a display substrate according to some embodiments of the present disclosure.

Referring to FIGS. 1, 2 and 6, the pixel driving circuit 700 provided in some embodiments of the present disclosure includes:

a current control circuit 100 configured to provide a constant current signal and an activation signal, a current switching circuit 200 configured to control the transmission of the constant current signal to a light-emitting device L under the control of the activation signal, and a grounding control circuit 300 configured to control the current control circuit 100 to provide the constant current signal and the activation signal. An input terminal of the current control circuit 100 is connected to a data line Data and a power line VCC, respectively. A control terminal of the current switching circuit 200 is connected to an output terminal of the current control circuit 100. An input terminal of the current switching circuit 200 is connected to the input terminal of the current control circuit 100. An output terminal of the current switching circuit 200 is connected to an input terminal of the light-emitting device L. A control terminal of the grounding control circuit 300 is connected to a gate line Gate. An input terminal of the grounding control circuit 300 is connected to an output terminal of the light-emitting device L. An output terminal of the grounding control circuit 300 is connected to a ground line GND.

The method for driving a pixel driving circuit provided by the embodiments of the present disclosure will be described below in detail with reference to FIGS. 1, 2 and 4. The method for driving a pixel driving circuit includes a step 100 (S100), a step 200 (S200) and a step 300 (S300).

In S100, a gate line Gate provides a gate signal, and the gate signal controls a grounding control circuit 300 to be switched on.

In S200, a data line Data provides a data signal, a power line VCC provides a power signal, and a current control circuit 100 generates a constant current signal and an activation signal according to the data signal and the power signal.

In S300, a current switching circuit 200 is switched on under the control of the activation signal, and the constant current signal is transmitted to a light-emitting device L through the current switching circuit 200 so that the constant current signal drives the light-emitting device L at constant current.

It can be known from the structure and the driving process of the pixel driving circuit provided in the embodiments, the input terminal of the current control circuit 100 is connected to the data line Data and the power line VCC, respectively, the control terminal of the current switching circuit 200 is connected to the output terminal of the current control circuit 100, the input terminal of the current switch circuit 200 is connected to the input terminal of the current control circuit 100, and the output terminal of the current switching circuit 200 is connected to the input terminal of the light-emitting device L, so the current switching circuit 200 can control the transmission of the constant current signal to the light-emitting device L under the control of the activation signal. Since the control terminal of the grounding control circuit 300 is connected to the gate line Gate, the input terminal of the grounding control circuit 300 is connected to the output terminal of the light-emitting device L and the output terminal of the grounding control circuit 300 is grounded, when the gate line Gate provides a gate signal, the gate signal can control the current control circuit 100 to provide the constant current signal and the activation signal through the grounding control circuit 300. Accordingly, it is ensured that the current switching circuit 200 transmits the constant current signal to the light-emitting device L according to the activation signal, so as to drive the light-emitting device L at constant current according to the constant current signal. Moreover, it can be known from FIGS. 1 and 2 that, in the pixel driving circuit provided in some embodiments of the present disclosure, as long as the current switching circuit 200 and the grounding control circuit 300 are connected in series to the current control circuit 100, the constant-current driving of the light-emitting device L can be realized. Thus, compared with the related art, the pixel driving circuit provided in some embodiments of the present disclosure is simple in structure.

In addition, when the pixel driving circuit provided in some embodiments of the present disclosure is applied to a display driving circuit, each gate line Gate is connected to a control end of a grounding control circuit 300 corresponding to one row (or column) of light-emitting devices L, and data lines Data corresponding to the light-emitting devices L in a same row (or column) and in different columns (or rows) are connected to current control circuits 100 corresponding to the light-emitting devices L in a same row (or column) and in different columns (or rows). Therefore, all light-emitting devices L in a display panel can be absolutely independently controlled when the pixel driving circuit provided in some embodiments of the present disclosure is applied to a display driving circuit.

In some embodiments, the light-emitting device L in the embodiments can be a constant-current driven OLED light-emitting device or a constant-current driven LED light-emitting device. This will not be limited herein.

In some embodiments, as shown in FIGS. 1 and 2, the current control circuit 100 in the embodiments includes an operational amplifier OP and a resistor Rs. A first phase input terminal of the operational amplifier OP is connected to the data line Data. The power line VCC is connected to a second phase input terminal of the operational amplifier OP via the resistor Rs. An output terminal of the operational amplifier OP is connected to the control terminal of the current switching circuit 200. The second phase input terminal of the operational amplifier OP is also connected to the input terminal of the current switching circuit 200. Since the first phase input terminal of the operational amplifier OP in the current control circuit 100 is connected to the data line Data, the power line VCC is connected to the second phase input terminal of the operational amplifier OP via the resistor Rs, the output terminal of the operational amplifier OP is connected to the control terminal of the current switching circuit 200 and the second phase input terminal of the operational amplifier OP is also connected to the input terminal of the current switching circuit 200, the output terminal and the second phase input terminal of the operational amplifier OP form feedback through the current switching circuit 200. Based on the case where the output terminal and the second phase input terminal of the operational amplifier OP form feedback through the current switching circuit 200, when the gate line Gate provides a gate signal to the grounding control circuit 300, the first phase input terminal and the second phase input terminal of the operational amplifier OP are in a virtual short-circuit state. When the first phase input terminal and the second phase input terminal of the operational amplifier OP are in a virtual short-circuit state, the voltage V2 at the second phase input terminal of the operational amplifier OP is equal to the voltage V1 at the first phase input terminal of the operational amplifier OP, so that the output voltage Vout, output by the output terminal of the operational amplifier OP, is equal to 0 (that is, the output terminal of the operational amplifier OP outputs a low level). When the voltage V2 at the second phase input terminal of the operational amplifier OP is equal to the voltage V1 at the first phase input terminal of the operational amplifier OP, the voltage Vdata of the data signal provided by the data line Data connected to the first phase input terminal of the operational amplifier OP is constant, so that the voltage V2 at the second phase input terminal of the operational amplifier OP is kept constant at V2=Vdata. Since the voltage V2 at the second phase input terminal of the operational amplifier OP is kept constant at V2=Vdata, the voltage of the power signal provided by the power line VCC is constant. Therefore, the current I flowing through the resistor Rs is kept constant when the current I flowing through the resistor Rs is equal to (Vcc−Vdata)/Rs. Therefore, in the pixel driving circuit provided in the embodiments of the present disclosure, by the virtual short-circuit state of the operational amplifier OP, the output voltage, output by the output terminal of the operation amplifier OP, is used as an activation signal, and the current I flowing through the resistor Rs is used as a constant current signal, so as to ensure that, under the control of the activation signal, the switch control circuit enables the constant current signal to drive the light-emitting device L to emit light.

In addition, the current switching circuit 200 functions as a switch for controlling the transmission of the constant current signal to the current switching circuit 200, so that no resistance drop will occur in the current switching circuit 200. Therefore, in the pixel driving circuit provided in some embodiments of the present disclosure, the constant-current driving can be realized by the current control circuit 100.

It is to be noted that, as shown in FIG. 1, the first phase input terminal of the operational amplifier OP is an in-phase input terminal, while the second phase input terminal of the operational amplifier OP is an inverse-phase input terminal.

Considering that the luminance of the light-emitting device L will influence the contrast of pictures displayed by a display device, in order to improve the contrast of the display device, in some embodiments, as shown in FIG. 1, the resistor Rs in the embodiments can be an adjustable resistor Rs for adjusting the current I flowing through the resistor Rs. Thus, when the current I flowing through the resistor Rs is used as a constant current signal for driving the light-emitting device L, the luminance of the light-emitting device L can be adjusted by the constant current signal. In other embodiments, as shown in FIG. 2, the current control circuit 100 further includes a voltage regulator 400. The voltage regulator 400 is connected to the data line DATA, so that the voltage of the data signal provided by the data line DATA can be adjusted. When the voltage of the data signal provided by the data line DATA changes while the resistance of the resistor Rs remains constant, since the current I flowing through the resistor Rs is equal to (Vcc−Vdata)/Rs, the current flowing through the resistor Rs can be adjusted by the voltage regulator 400. In this way, the luminance of the light-emitting device L is adjusted.

In some embodiments, when the pixel driving circuit is used as each pixel driving circuit included in a display driving circuit, the contrast of pictures displayed by the display device can be adjusted from a sub-pixel level by the pixel driving circuit.

In some embodiments, the current switching circuit 200 of various structures will be described below in detail with reference to the accompanying drawings.

For example, as shown in FIGS. 1 and 2, the current switching circuit 200 in the pixel driving circuit includes a first transistor VT1 and a second transistor VT2. A control electrode of the first transistor VT1 is connected to the output terminal of the current control circuit 100. A first electrode of the first transistor VT1 is connected to the input terminal of the current control circuit 100. A second electrode of the first transistor VT1 is connected to a control electrode of the second transistor VT2. A second electrode of the second transistor VT2 is connected to the input terminal of the current control circuit 100. A first electrode of the second transistor VT2 is connected to the input terminal of the light-emitting device L.

The first transistor VT1 and the second transistor VT2 being the same or opposite in type is determined by the level of the activation signal from the current control circuit 100 in the embodiments. When the activation signal from the current control circuit 100 in the embodiments is a low level signal, the first transistor VT1 and the second transistor VT2 are opposite in type.

By taking the first transistor VT1 being a PNP transistor and the second transistor VT2 being an NPN transistor as example, with reference to FIGS. 1 and 2, the following description will be given to how the current switching circuit 200 controls the transmission of the constant current signal to the current switching circuit 200 of the light-emitting device L under the control of the activation signal.

The activation signal provided by the current control circuit 100 is a low level signal, and the current control circuit 100 provides the activation signal to the base of the first transistor VT1, so that the constant current signal provided by the current control circuit 100 enters the first transistor VT1 from the emitter of the first transistor VT1. Then, the constant current signal entering the first transistor VT1 flows out from the collector of the first transistor VT1 and is then provided to the base of the second transistor VT2 so as to control the second transistor VT2 to be switched on. At the same time when the constant current signal provided by the current control circuit 100 enters the first transistor VT1 from the emitter of the first transistor VT1, the constant current signal provided by the current control circuit 100 enters the second transistor VT2 from the collector of the second transistor VT2. When the second transistor VT2 is switched on, the constant current signal entering the second transistor VT2 is transmitted from the emitter of the second transistor VT2 to the light-emitting device L, so that the constant current signal drives the light-emitting device L at constant current and the light-emitting device L then emits light.

During the specific process of controlling, by the current switching circuit 200, the transmission of the constant current signal to the current switching circuit 200 of the light-emitting device L under the control of the activation signal, it can be found that the current switching circuit 200 includes two transistors of different types. The two transistors of different types cooperate with the current control circuit 100 to realize the control on the transmission of the constant current signal.

In some embodiments, as shown in FIGS. 1 and 2, the grounding control circuit 300 in the embodiments includes a third transistor VT3. A control electrode of the third transistor VT3 is connected to the gate line Gate. A second electrode of the third transistor VT3 is connected to the output terminal of the light-emitting device L. A first electrode of the third transistor VT3 is grounded.

Exemplarily, the third transistor VT3 is an NMOS transistor. The gate of the third transistor VT3 is connected to the gate line Gate. The drain of the third transistor VT3 is connected to the output terminal of the light-emitting device L. The source of the third transistor VT3 is connected to the ground line GND.

When the gate line Gate provides a gate signal, the gate signal controls the third transistor VT3 to be switched on, so that the current flowing from a light-emitting signal is fed into the ground line GND through the third transistor VT3.

In some embodiments, the grounding control circuit 300 in the embodiments can also be another electronic device which can be switched on under the control of the gate signal. This will not be repeated here.

Figure 4:
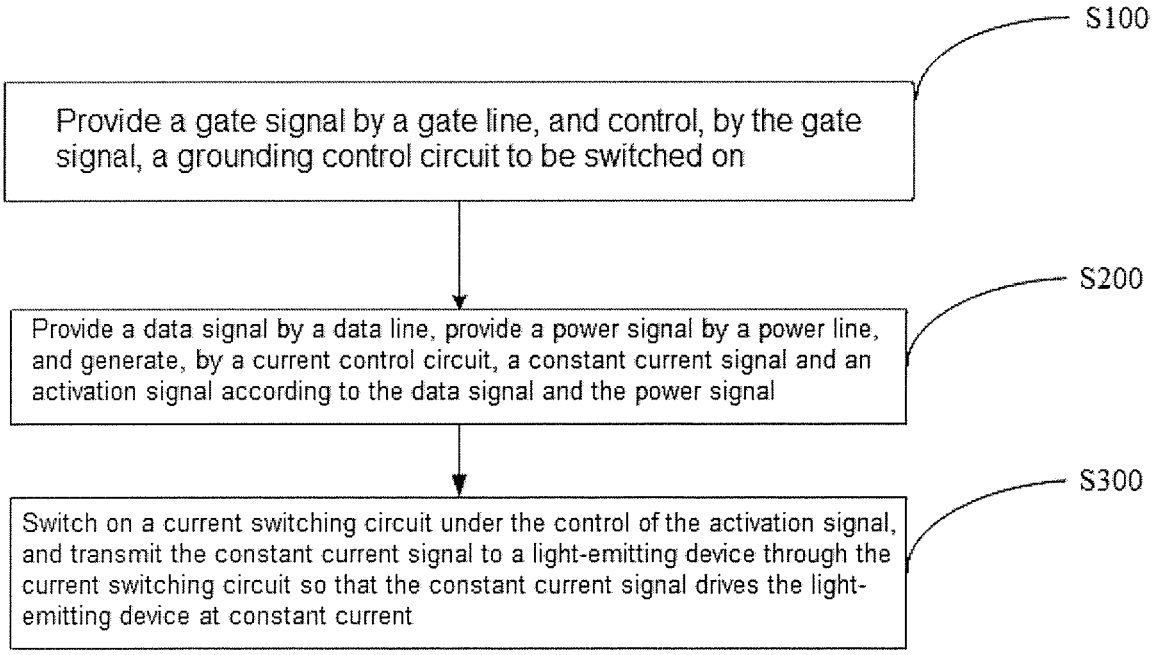
FIG. 4 is a first flowchart of a method for driving a pixel driving circuit according to some embodiments of the present disclosure.

As shown in FIGS. 1 and 4, some embodiments of the present disclosure further provide a method for driving the pixel driving circuit, including a step 100 (S100), a step 200 (S200) and a step (S300).

In S100, a gate line Gate provides a gate signal. The gate signal controls a grounding control circuit 300 to be switched on.

In S200, a data line Data provides a data signal. A power line VCC provides a power signal. A current control circuit 100 generates a constant current signal and an activation signal according to the data signal and the power signal.

In S300, a current switching circuit 200 is switched on under the control of the activation signal. The constant current signal is transmitted to a light-emitting device L through the current switching circuit 200, so that the constant current signal drives the light-emitting device L at constant current.

Compared with the related art, the method for driving a pixel driving circuit provided in some embodiments of the present disclosure has the same beneficial effects as the pixel driving circuit described above, and these beneficial effects will not be repeated here.

Figure 5:
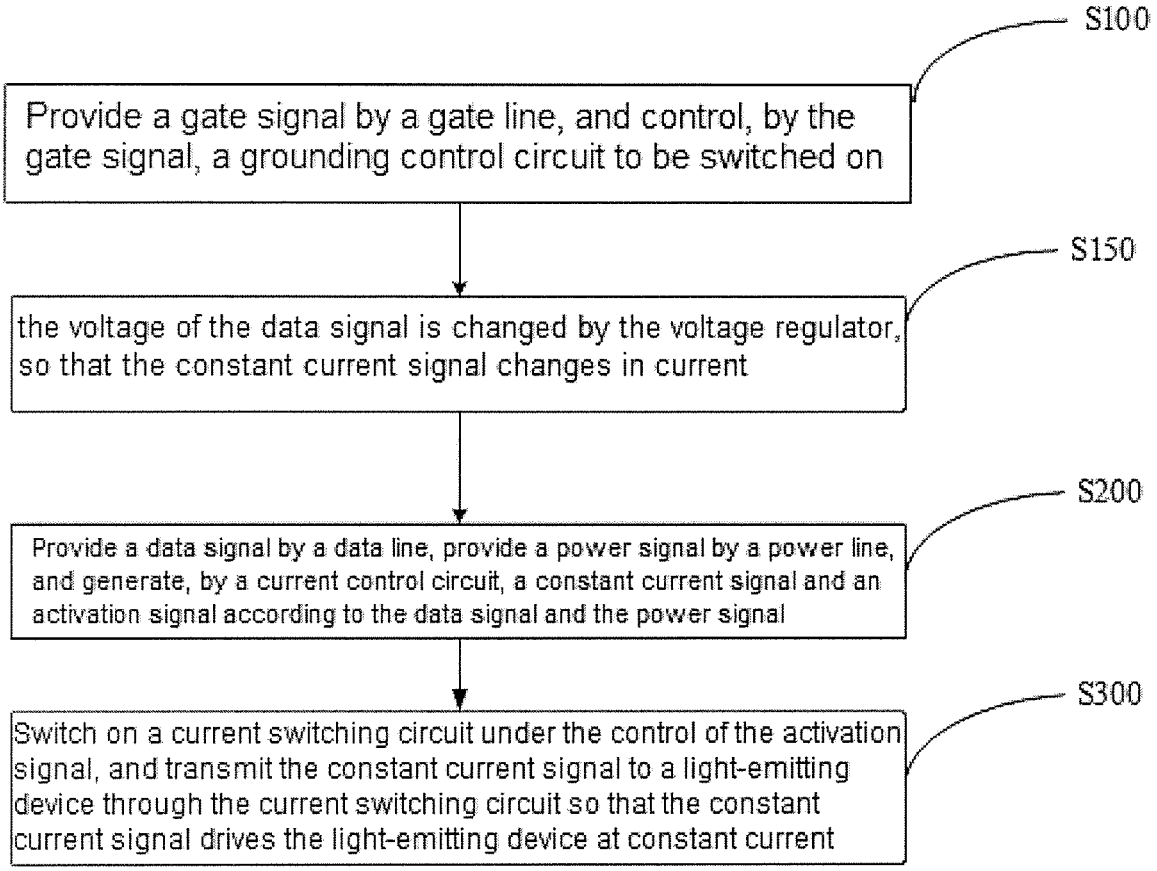
FIG. 5 is a second flowchart of the method for driving a pixel driving circuit according to some embodiments of the present disclosure.

In some embodiments, as shown in FIGS. 2 and 5, when the pixel driving circuit provided in the embodiments includes a voltage regulator 400, before the data line Data provides a data signal, the driving method in the embodiments further includes a step 150 (S150).

In S150, the voltage of the data signal is changed by the voltage regulator 400, so that the constant current signal changes in current.

Figure 3:
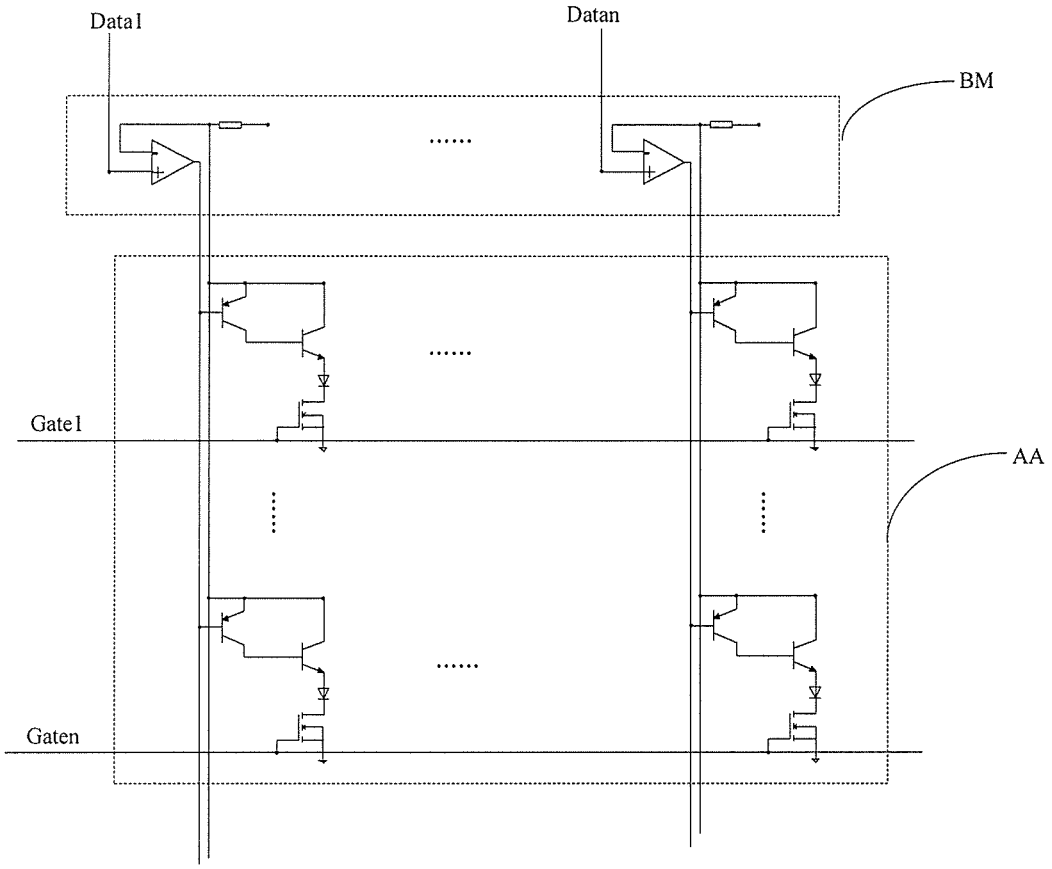
FIG. 3 is a schematic structure diagram of a display driving circuit according to some embodiments of the present disclosure.

As shown in FIGS. 3 and 6, some embodiments of the present disclosure further provide a display driving circuit 620, including at least one pixel driving circuit 700 described in the above technical solutions.

Compared with the related art, the display driving circuit provided in some embodiments of the present disclosure has the same beneficial effects as the pixel driving circuit described above, and these beneficial effects will not be repeated here.

In some embodiments, as shown in FIG. 6, there is a plurality of pixel driving circuits 700 which are arranged in an array.

As shown in FIG. 3, when the display driving circuit adopts row-by-row scanning, the pixel driving circuits in each column share a current control circuit 100. Similarly, when the display driving circuit adopts column-by-column scanning, the pixel driving circuits in each row share a current control circuit 100.

As shown in FIG. 3, when the display is performed by row-by-row scanning, since there is one light-emitting device L in a same row and a same column, even if the pixel driving circuits in each column share a current control circuit 100, mutual interference will not occur during the constant-current driving of light-emitting devices L in a same column and in different rows when a gate signal is provided to the gate lines Gate row by row and each data line Data in each row of pixel driving circuits provides a data signal. Thus, it is ensured that the light-emitting devices L in a same column and in different rows are independently driven at constant current. Similarly, when the display is performed by column-by-column scanning, since there is one light-emitting device L in a same row and a same column, even if the pixel driving circuits in each row share a current control circuit 100, mutual interference will not occur during the constant-current driving of light-emitting devices L in a same row and in different columns when a gate signal is provided to the gate lines Gate column by column and each data line Data in each column of pixel driving circuits provides a data signal. Thus, it is ensured that the light-emitting devices L in a same row and in different columns are independently driven at constant current.

Moreover, when the pixel driving circuits in each column share a current control circuit 100 or the pixel driving circuits in each row share a current control circuit 100, the cost can be minimized, and the unnecessary space occupation can also be reduced, so that more space is saved for the formation of light-emitting devices L and the aperture ratio of the display device is increased.

Exemplarily, when the display driving circuit drives the light-emitting devices L to emit light by row-by-row scanning, each gate line Gate is connected to control terminals of grounding control circuits 300 in one row of pixel driving circuits, and different data lines are connected to the input terminals of the current control circuits 100 in the corresponding pixel driving circuits.

As shown in FIG. 3, the pixel driving circuits in the display driving circuit are arranged in an n×n matrix. The first gate line Gate1 is connected to the control terminal of the grounding control circuit 300 (the gate of the third transistor VT3) in each pixel driving circuit in the first row of pixel driving circuits. The first data line Data1 is connected to the input terminal of the current control circuit 100 (i.e., the first phase input terminal of the operational amplifier OP) shared by the pixel driving circuits in the first column. The $n^{th}$ gate line Gaten is connected to the control terminal of the grounding control circuit 300 (the gate of the third transistor VT3) in each pixel driving circuit in the $n^{th}$ row of pixel driving circuits. The $n^{th}$ data line Datan is connected to the input terminal of the current control circuit 100 (i.e., the first phase input terminal of the operational amplifier OP) shared by the pixel driving circuits in the $n^{th}$ column.

When the display driving circuit drives the light-emitting devices to emit light by row-by-row scanning, the $k^{th}$ gate line provides the $k^{th}$ gate signal Vgk within the $k^{th}$ period of time, the $k^{th}$ data line provides the $k^{th}$ data signal Vdatak to the light-emitting device in the $k^{th}$ row and the $k^{th}$ column, and the $(k+1)^{th}$ data line provides the $(k+1)^{th}$ data signal Vdatak+1 to the light-emitting device in the $k^{th}$ row and the $(k+1)^{th}$ column.

The constant current signal for driving the light-emitting device in the $k^{th}$ row and the $k^{th}$ column is $I_{k,k}=(V_{cc}-V_{datak})/R_s$, and the constant current signal for driving the light-emitting device in the $k^{th}$ row and the $(k+1)^{th}$ column is $I_{k,k+1}=(V_{cc}-V_{datak+1})/R_s$.

When the display driving circuit drives the light-emitting devices to emit light by row-by-row scanning, since the $k^{th}$ gate line provides the gate signal Vgk and the constant current signals for the light-emitting devices in the $k^{th}$ row and in different columns are controlled by different data lines, the luminance of the light-emitting devices in the $k^{th}$ row and in different columns can be adjusted by modulating the data signals provided by the different data lines. Of course, it is possible that the luminance of the light-emitting devices in the $k^{th}$ row and in different columns is adjusted by adjusting the resistance of the resistors Rs corresponding to the light-emitting devices in a same row and in different columns.

When the pixel driving circuits include a voltage regulator, the luminance of the light-emitting devices in the $k^{th}$ row and in different columns can be adjusted by adjusting the voltage regulators included in the pixel driving circuits corresponding to the light-emitting devices in a same row and in different columns.

As shown in FIG. 6, the embodiments of the present disclosure further provide a display substrate 600. The display substrate includes the display driving circuit 620 described above.

Compared with the related art, the display substrate provided in the embodiments of the present disclosure has the same beneficial effects as the display driving circuit, and the beneficial effects will not be repeated here.

It should be understood that, as shown in FIG. 6, the display substrate 600 further includes a base substrate 610. The display driving circuit 620 is located on the surface of the base substrate 610.

In order to reduce the space occupation of the pixel driving circuits within a display region AA of the display substrate 600, in some embodiments, as shown in FIGS. 3 and 6, the current control circuits 100 included in the pixel driving circuits 700 in the display driving circuit 620 are located within a border region BM of the display substrate, in order to increase the aperture ratio of the display substrate.

Figure 7:
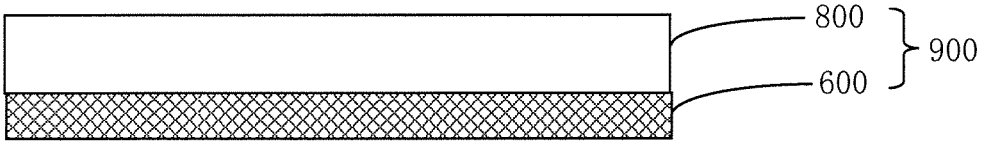
FIG. 7 is a first schematic structure diagram of a display device according to some embodiments of the present disclosure.

As shown in FIG. 7, the embodiments of the present disclosure further provide a display device 900. The display device 900 includes the display substrate 600 described above.

Compared with the related art, the display device 900 provided in the embodiments of the present disclosure has the same beneficial effects as the display substrate 600, and the beneficial effects will not be repeated here.

Figure 8:
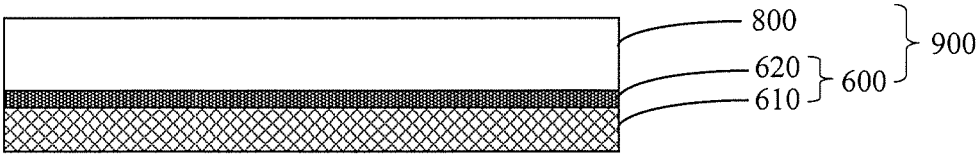
FIG. 8 is a second schematic structure diagram of the display device according to some embodiments of the present disclosure.

It should be understood that, as shown in FIG. 7, the display device further includes a packaging cover plate 800 disposed on the display surface of the display substrate 600. As shown in FIG. 8, some embodiments of the present disclosure further provide a display device 900. The display device 900 includes the display driving circuit 620 described above.

Compared with the related art, the display device 900 provided in the embodiments of the present disclosure has the same beneficial effects as the pixel driving circuit 700, and the beneficial effects will not be repeated here.

It should be understood that, as shown in FIG. 8, the display driving circuit 620 is disposed on a base substrate 610 to form a display substrate 600. The packaging cover plate 800 is disposed on the display surface of the display substrate 600.

In some embodiments, in order to further avoid a wider border region BM of the display device, which is caused by providing the current control circuits 100 within the border region BM of the display substrate, as shown in FIGS. 2, 6 and 8, the current control circuits 100 included in the pixel driving circuits 700 in the display driving circuit 620 are integrated into a driving chip. It is advantageous for narrowing the border of the display device.

The display device provided in the embodiments can be a mobile phone, a tablet computer, a TV set, a display, a notebook computer, a digital photo frame, a navigator or any product or component having a display function.

In the descriptions of the implementations, specific features, structures, materials or characteristics can be combined appropriately in any one or more embodiments or examples.

The foregoing descriptions merely show specific implementations of the present disclosure, and the protection scope of the present disclosure is not limited thereto. Any person of skill in the art can readily conceive of variations or replacements without departing from the technical scope disclosed by the embodiments of the present disclosure, and these variations or replacements shall fall into the protection scope of the present disclosure. Therefore, the protection scope of the present disclosure shall be subject to the protection scope of the appended claims.

What is claimed is:

1. A pixel driving circuit, comprising:

a current control circuit configured to provide a constant current signal and an activation signal to a current switching circuit;

the current switching circuit configured to control the transmission of the constant current signal to a light-emitting device under the control of the activation signal; and a grounding control circuit configured to control the current control circuit to provide the constant current signal and the activation signal, wherein:

an input terminal of the current control circuit is connected to a data line and a power line, respectively; a control terminal of the current switching circuit is connected to an output terminal of the current control circuit, and an output terminal of the current switching circuit is connected to an input terminal of the light-emitting device; and, a control terminal of the grounding control circuit is connected to a gate line, an input terminal of the grounding control circuit is connected to an output terminal of the light-emitting device, and an output terminal of the grounding control circuit is grounded, and the current control circuit comprises an operational amplifier and a resistor; a first phase input terminal of the operational amplifier is connected to the data line; the power line is connected to a second phase input terminal of the operational amplifier via the resistor: an output terminal of the operational amplifier is connected to the control terminal of the current switching circuit; and, the second phase input terminal of the operational amplifier is also connected to the input terminal of the current switching circuit;

the current switching circuit comprises a first transistor and a second transistor; a control electrode of the first transistor is connected to the output terminal of the current control circuit, a first electrode of the first transistor is connected to the input terminal of the current control circuit, and a second electrode of the first transistor is connected to a control electrode of the second transistor, and, a second electrode of the second transistor is connected to the input terminal of the current control circuit, and a first electrode of the second transistor is connected to the input terminal of the light-emitting device;

the grounding control circuit comprises a third transistor; and, a control electrode of the third transistor is connected to the gate line, a second electrode of the third transistor is connected to the output terminal of the light-emitting device, and a first electrode of the third transistor is grounded.

2. The pixel driving circuit according to claim 1, wherein the current control circuit further comprises a voltage regulator connected to the data line.

3. The pixel driving circuit according to claim 1, wherein the type of the first transistor is opposite to the type of the second transistor.

4. A method for driving the pixel driving circuit according to claim 1, comprising steps of:

providing a gate signal by a gate line, and switching on a grounding control circuit in response to the gate signal;

providing a data signal by a data line, providing a power signal by a power line, and generating, by a current control circuit, a constant current signal and an activation signal according to the data signal and the power signal; and switching on a current switching circuit under the control of the activation signal, and transmitting the constant current signal to a light-emitting device through the current switching circuit so that the constant current signal drives the light-emitting device at constant current.

5. The method for driving a pixel driving circuit according to claim 4, wherein, when the pixel driving circuit comprises a voltage regulator, before the step of providing a data signal by a data line, the driving method further comprises a step of:

changing the voltage of the data signal by the voltage regulator, so that the constant current signal changes in current.

6. A display driving circuit, comprising at least one pixel driving circuit according to claim 1.

7. The display driving circuit according to claim 6, wherein there is a plurality of pixel driving circuits which are arranged in an array, and the pixel driving circuits in each row, among the plurality of pixel driving circuits arranged in an array, share a current control circuit; or the pixel driving circuits in each column, among the plurality of pixel driving circuits arranged in an array, share a current control circuit.

8. A display substrate, comprising the display driving circuit according to claim 6.

9. The display substrate according to claim 8, wherein current control circuits contained in pixel driving circuits in the display driving circuit are located within a border region of the display substrate.

10. A display device, comprising the display substrate according to claim 8.

11. A display device, comprising the display driving circuit according to claim 6.

12. The display device according to claim 11, wherein the current control circuits contained in the pixel driving circuits in the display driving circuit are integrated into a driving chip.

13. The pixel driving circuit according to claim 2, wherein the current switching circuit comprises a first transistor and a second transistor;

a control electrode of the first transistor is connected to the output terminal of the current control circuit, a first electrode of the first transistor is connected to the input terminal of the current control circuit, and a second electrode of the first transistor is connected to a control electrode of the second transistor; and, a second electrode of the second transistor is connected to the input terminal of the current control circuit, and a first electrode of the second transistor is connected to the input terminal of the light-emitting device.

14. The pixel driving circuit according to claim 2, wherein the grounding control circuit comprises a third transistor; and, a control electrode of the third transistor is connected to the gate line, a second electrode of the third transistor is connected to the output terminal of the light-emitting device, and a first electrode of the third transistor is grounded.

* * * * *